US005762724A

United States Patent [19]

Yamaoka et al.

[11] Patent Number: 5,762,724

[45] Date of Patent: Jun. 9, 1998

[54] HIGH STRENGTH STEEL STRAND FOR PRESTRESSED CONCRETE AND METHOD FOR MANUFACTURING THE SAME

[75] Inventors: Yukio Yamaoka, Toyonaka; Masao Yamada; Masaru Kodama, both of Amagasaki; Toshiki Suwa, Amagasaki; Nobuhiko Ibaraki; Masato Kaiso, both of Kobe, all of Japan

[73] Assignee: Shinko Kosen Kogyo Kabushiki Kaisha, Hyogo-ken, Japan

[21] Appl. No.: 701,272

[22] Filed: Aug. 22, 1996

[30] Foreign Application Priority Data

Aug. 24, 1995 [JP] Japan ..... 7-215957

[51] Int. Cl.[6] ..... C22C 38/02; C21D 8/06

[52] U.S. Cl. ..... 148/320; 148/328; 148/598; 148/599

[58] Field of Search ..... 148/595, 598, 148/599, 328, 320

[56] References Cited

U.S. PATENT DOCUMENTS

| | | | |
|---|---|---|---|
| 3,196,052 | 7/1965 | Hann . | |
| 4,889,567 | 12/1989 | Fujiwara et al. | 148/598 |
| 5,156,692 | 10/1992 | Tsukamoto | 148/598 |
| 5,458,699 | 10/1995 | Tsukamoto et al. | 148/598 |

*Primary Examiner*—Deborah Yee
*Attorney, Agent, or Firm*—Jordan and Hamburg

[57] ABSTRACT

A high strength steel strand for PC of a wire material having a pearlite structure and containing 0.80 to 1.30% of C, 0.60 to 2.50% of Si and 0.30 to 1.50% of Mn, remainder being Fe and unavoidable impurities, wherein a cementite portion of the wire material comprises a mixed structure of fibrous cementite and granular cementite, the volumetric proportion of the granular cementite to the total cementite is 10 to 40%, the particle diameter of the granular cementite is 40 to 300Å, and the strand has a tensile strength of 235 kgf/mm$^2$ or higher and an elongation of 3.5% or greater.

6 Claims, 5 Drawing Sheets

HIGH STRENGTH STEEL STRAND FOR PRESTRESSED CONCRETE AND METHOD FOR MANUFACTURING THE SAME

BACKGROUND OF THE INVENTION AND PRIOR ART STATEMENT

The present invention relates to a high strength steel strand for prestressed concrete (hereinafter referred to as steel strand for PC) and a method for manufacturing the same.

In recent years, as concrete has become more strengthened, concrete structures have become larger, longer and/or lighter-weight. Reflecting this, there is a strong demand to strengthen steel strand for PC for reinforcing the concretes.

Many researches and developments have been and are being made on steel wires having a high strength and an excellent ductility and on methods for manufacturing such wires. For examples, Japanese Examined Patent Publication No. 5-26851 discloses a method for manufacturing a steel wire having a high strength and a high ductility according to which a wire is cooled with water immediately after being drawn. Further, Japanese Unexamined Patent Publication No. 3-271329 discloses a method for manufacturing a high strength wire having a fine pearlite structure not including pro-eutectoid cementite. Further, Japanese Unexamined Patent Publication No. 2-197524 discloses a method for manufacturing a fine high tensile steel wire. Relationship between the diameter and the tensile strength of the wires disclosed in the above publications is shown in FIG. 1. A horizontal axis of FIG. 1 represents the diameter of wires and strands, whereas a vertical axis of FIG. 1 represents the tensile strength of these wires when they show elongation of 3.5% or greater.

The term "elongations" is used to indicate a degree of ductility for the material. In case of the steel strand for PC, the elongation is measured by the following steps: setting a test specimen by the chucks in a span of 600 mm, and then pulling opposite ends thereof fill fracture takes place and measuring the elongated length at the time of fracture.

In the vertical axis, an elongation of 3.5% as shown in "JIS G 3536 steel wires and steel strands for prestressed concrete" is used as a standard for ductility. Further, the horizontal axis has a logarithmic scale. Samples having a diameter of smaller than 9 mm are non-stranded wires (or element wires), and those having a diameter of 9 mm or larger are steel strands. As can been seen from FIG. 1, the tensile strength of the strands is about 220 to 230 kgf/mm$^2$. The tensile strength of the wires is normally 230 kgf/mm$^2$ or less than 230 kgf/mm$^2$. Some wires have a tensile strength of 230 to 245 kgf/mm$^2$. However, if a strand is made of these wires, a shearing force acts at points of contacts between the strands, thereby causing a fracture. Since a maximum shearing strength is about 60% of a tensile strength, it is difficult to highly strengthen the strands. Accordingly, the tensile strength of the strands tends to be 230 kgf/mm$^2$ or less than 230 kgf/mm$^2$.

As disclosed in "Prestressed Concrete Vol. 26, No. 3, May, 1984", from an industrial point of view, 230 kgf/mm$^2$ is said to be substantially an upper limit of the tensile strength range for generally and frequently used steel strands which are made of seven wires and has a diameter of 12.7 mm for the following reason. Generally, during manufacturing of steel strands for PC, after drawn wires are stranded or braided, an aging treatment is performed in which the strand is heated at a temperature of 300° to 450° C. to remove residual strains and improve a relaxation characteristic. In the case of steel wires having a tensile strength of larger than 230 kgf/mm$^2$ as described above, the strands made of these wires cannot be sufficiently heated during a short time aging treatment after the stranding treatment, with the result that embrittlement occurs due to a strain aging and, thus, ductility cannot be recovered. In order to recover ductility, it can be considered to perform the aging treatment for a longer period, e.g. several tens of minutes. However, in such a case, tensile strength is lowered, productivity is lowered, and there are problems from an industrial point of view. It can be also considered to shorten a heating time by raising an aging temperature, for example, to 700° C. or higher. In such a case, operability is poor because the range of the heating time which provides the strands with satisfactory properties is very narrow, and the properties of the products largely vary with a small variation of the heating time. As a result, it becomes difficult to strengthen the strands because low strength strands are also included.

In view of the problems residing in the prior art, an object of the present invention is to provide a high strength steel strand for PC and a method for manufacturing such a strand. According to the method, the strands having stable properties are obtainable and are allowed to have a tensile strength of 235 kgf/mm$^2$ or higher and an elongation of 3.5% or larger owing to an industrially suitable aging treatment Accordingly, one aspect of the invention is directed to a high strength steel strands for PC of a wire material having a pearlite structure and containing 0.80 to 1.30% of C, 0.60 to 2.50% of Si and 0.30 to 1.50% of Mn, remainder being Fe and unavoidable impurities, wherein a cementite portion of a pearlite structure comprises a mixed structure of fibrous cementite and granular cementite, the volumetric proportion of the granular cementite to the total cementite is 10 to 40%, the particle diameter of the granular cementite is 40 to 300Å, and the strand has a tensile strength of 235 kgf/mm$^2$ or higher and an elongation of 3.5% or greater.

With this structure, a high strength strand for PC can exhibit excellent mechanical properties; a high tensile strength and a high ductility.

Another aspect of the invention is directed to a method of producing a high strength steel strands for PC of a wire material having a pearlite structure and containing 0.80 to 1.30% of C, 0.60 to 2.50% of Si and 0.30 to 1.50% of Mn, remainder being Fe and unavoidable impurities, comprising the steps of:

a lead patenting step in which the wire is lead patented;

a drawing step in which the wire is drawn;

a stranding step in which the wire is stranded;

an aging step in which the wire is applied with a plastic elongation of 0.4 to 3% while being kept at a temperature of 200° to 600° C. for a time duration of 2 to 1500 seconds.

According to this method, a high strength steel strand for PC having a tensile strength of 235 kgf/mm$^2$ or higher and an elongation of 3.5% or greater can be stably manufactured by choosing an adequate time duration for the strand to undergo plastic deformation during the aging step with respect to a selected aging temperature within the specified range.

Another aspect of the invention, the plastic elongation applied to the strand can be 0.8 to 3%.

With this method, a high strength strand for PC having a tensile strength of 235 kgf/mm$^2$ or higher and an elongation of 5% or greater can be stably manufactured by choosing an adequate time duration for the strand to undergo plastic deformation during the aging step with respect to a selected aging temperature within the specified range.

Yet another aspect of the invention, in the aging step a minimum time required for the strand to be subjected to the plastic elongation as a function of the temperature is determined in accordance with FIG. 2.

With reference to FIG. 2 of this application, the minimum time required for the strand to be subjected to the plastic elongation to achieve specified mechanical properties such as; a tensile strength and an elongation that represents a ductility of the wire, can be easily measured. For example, the conditions to gain the strand of 235 kgf/mm$^2$ (in the tensile strength) or higher and 3.5% (in the elongation) or greater, or the strand of 235 kgf/mm$^2$ or higher and 5.0% or greater respectively can be determined as functions of the aging temperature and the rate of the plastic deformation (a plastic elongation).

Yet another aspect of the invention, in the aging step a time range of the strand to be subjected to the plastic elongation as a function of the rate of plastic deformation (elongation) is determined in accordance with FIG. 4.

With reference to FIG. 4, a time range of the strand to be subjected to the plastic elongation to achieve superior mechanical properties such as a tensile strength of 235 kgf/mm$^2$ or higher and an elongation of 3.5% or greater can be easily determined as a function of the rate of plastic deformation (a plastic elongation).

Still another aspect of the invention, in the aging step the time duration of the strand to be subjected to the plastic elongation as a function of the temperature is determined in accordance with FIGS. 2 and 4.

Though FIG. 2 provides a minimum holding time required for the strand with specific characteristics recited in the above to undergo plastic elongation during the aging treatment as a function of not only an aging temperature but also the plastic elongation (a rate of plastic deformation), this figure does not provide a maximum holding time for the strand to undergo plastic deformation during the aging treatment beyond which the wire does not exhibit superior properties. Moreover, since the exact curved lines for the strand undergoing plastic deformation of some rate between 0.4% and 0.8% or 0.8% and 3.0% were not provided in FIG. 2, it requires the one to draw an estimated curved line in FIG. 2 in case the plastic deformation applied to the strand is within the previously mentioned two ranges, namely 0.4–0.8% and 0.8–3.0% to estimate the minimum holding time required for the strand to achieve superior properties. In this case, FIG. 4 would provide a better guide line for the one to know the minimum time required for the strand to undergo plastic deformation during the aging treatment as a function of rate of plastic deformation along a X-axis. In addition, FIG. 4 provides also an upper limit for the holding time of the strand to undergo plastic deformation during the aging treatment Therefore, the one can easily estimate with reference to both figures the appropriate holding time for the strand to undergo plastic deformation to achieve superior properties; a higher tensile strength and a greater elongation while meeting the requirements of the production side.

These and other objects, features and advantages of the present invention will become more apparent upon a reading of the following detailed description and accompanying drawings.

MODES FOR EMBODYING THE INVENTION

Figure 1:
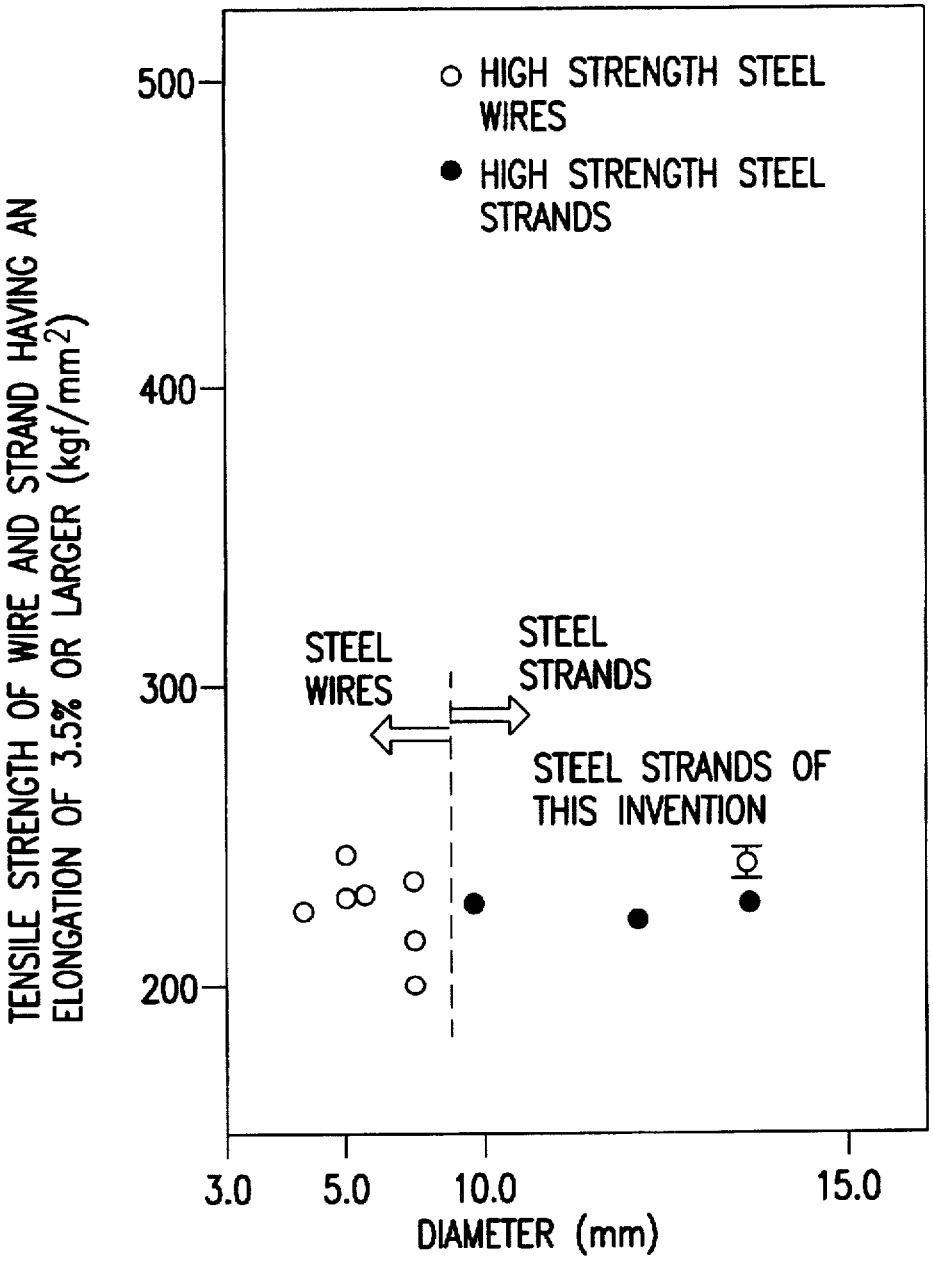
FIG. 1 is a graph showing a relationship between the diameter of high strength steel wires and steel strands and the tensile strength thereof when they have an elongation of 3.5% or greater.

The content of each of the above components of this invention is limited to the range described in the above for the following reasons.

C: C is an element efficient and economical to increase strength to be obtained by patenting treatment However, if the content of C is less than 0.8%, a desired strength cannot be obtained. Further, if the content of C is in excess of 1.3%, reticular cementite deposits in a grain boundary, as a result, the ductility of the wires is considerably reduced. Accordingly, the range of the content of C is set between 0.8% and 1.3%.

Si: Si is an element necessary as a deoxidizer, and dissolves into ferrite, thereby remarkably strengthening a solid solution. Further, Si in ferrite acts to prevent a reduction of the wire strength caused by the aging treatment performed after the drawing treatment. Thus, Si is an inevitable element to manufacture a high strength steel strands. Therefore, the lower limit of the range of the content of Si is set at 0.60%. On the other hand, if Si is excessively added, an excessive amount of $SiO^2$ and its relating materials exist in the wire. This causes a reduction in the ductility of the steel wires after the drawing. Thus, the upper limit of the range of the content of Si is set at 2.50%.

Mn: Mn is also an element necessary as a deoxidizer and effective in making the structure of the steel wire uniform in its cross section by improving hardenability of steel. Therefore, the lower limit of the range of the content of Mn is set at 0.30%. However, an excessive addition of Mn is not practical because it takes a longer time to transfer austenite structure to pearlite structure during the patenting treatment. Accordingly, the upper limit of the range of the content of Mn is set at 1.5%.

Remainder includes Fe and unavoidable impurities.

Lead patenting is performed during the patenting treatment, normally at a temperature of 540° to 570° C. without adding any special conditions.

Figure 2:
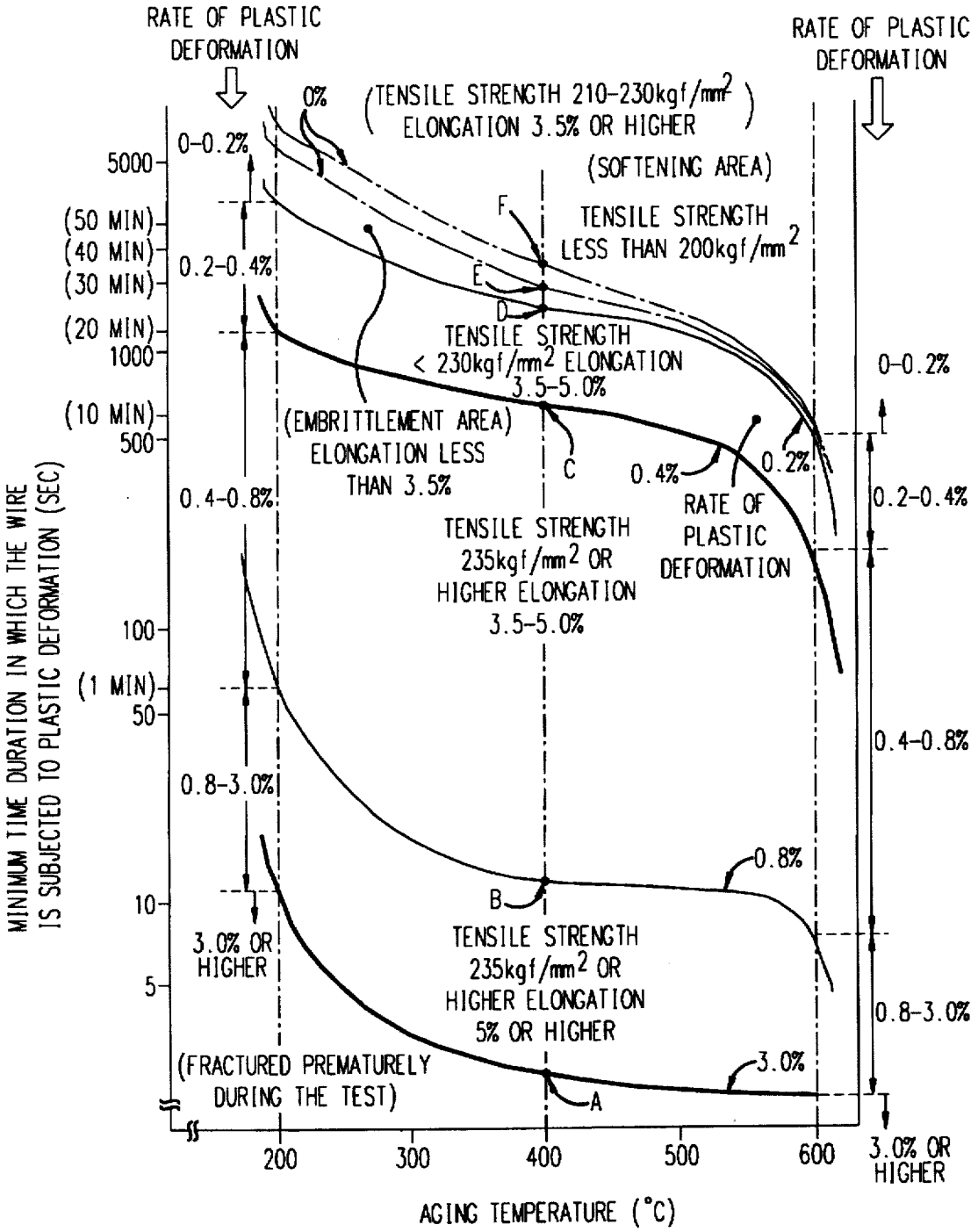
FIG. 2 is a graph showing a characteristic of strands in relation to aging temperature, a rate of permitted plastic deformation at given aging temperature, and a plastic deformation minimum holding time during which the strands are permitted to undergo a plastic deformation.

After being lead-patented, drawn and stranded, wires made of steel including 0.94% of C, 1.45% of Si and 0.52% of Mn by weight were subjected to aging treatment. Shown in FIG. 2 is the characteristic of the strands when the aging temperature, the holding time and the plastic elongation (rate of deformation) given under said aging temperature and the holding time are changed. FIG. 2 shows a characteristic of the strands at the fixed aging temperature with the fixed plastic deformation for the fixed holding time under said aging temperature. The plastic deformation holding time shown by the curves is the minimum time duration during which the strands are caused to undergo a plastic deformation by applying a tensile force in order to achieve desired mechanical properties, higher tensile strength and higher ductility, of the strands while being heated at a specified temperature and the deformed wires are kept at that temperature. An aging temperature lower than 200° C. is not effective from an industrial point of view because the aging treatment takes an extremely long time for the curves exhibit sharp increase in the minimum holding time as the aging temperature becomes lower than 200° C. Further, an aging temperature of higher than 600° C. is not suitable because the properties of the strand drastically change. Accordingly, the aging temperature is set between 200° C. and 600° C.

Figure 5:
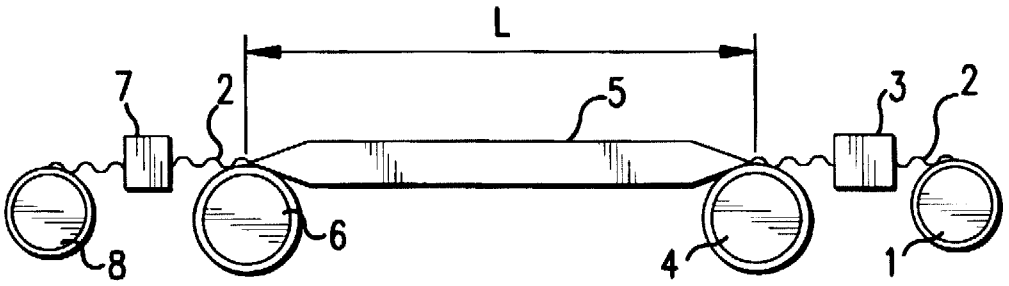
FIG. 5 is a diagram showing an exemplary apparatus for implementing a method according to the invention.

FIG. 5 shows an apparatus for applying a heating treatment to strands. The strand supplied from a strand supply drum 1 is preheated in a preheating furnace 3. The strand is fed via a drive pulley 4, a heating furnace 5 and a drive pulley 6, is cooled in a cooling bath 7, and is taken up by a take-up drum 8. The strand is heated at a temperature of about 200° C. or lower in the preheating furnace 3, and is wound around the drive pulley 4 three times. Thereafter, the strand is fed to the heating furnace 5 and is wound around the drive pulley 8 several times again. By setting a rotating speed V1 of the drive pulley 6 slightly faster than a rotating speed V0 of the drive pulley 4, the plastic elongation of the strand kept at the aging temperature can be desirably set. At this stage, the strand is permitted to have a plastic elongation ($\epsilon$) expressed in the following equation:

$$\epsilon(\%)=(V1-V0)\times 100/V0.$$

When the rate of deformation caused by the given plastic elongation is in excess of 3.0%, there is a possibility that the strand is fractured during the operation. Accordingly, an upper limit of the rate of deformation (or plastic elongation) is set at 3.0%.

In FIG. 2, at the treatment temperature of 400° C., a steel strand having excellent properties: a tensile strength of 235 kgf/mm$^2$ or higher and an elongation of 5% or greater, can be obtained if the aging treatment is performed for 2.4 seconds (point A) or more while giving a strain (or a plastic elongation) of 3.0%. This can be also seen in the aging treatment performed while a strain (or a plastic elongation) of 0.8% is given (point B) for little less than 12 seconds. If the strain (or a plastic elongation) is 0.4% (point C) or less, the aging treatment takes 650 seconds (10.8 minutes) or longer. As a result, the strand cannot be strengthened because the tensile strength thereof does not reach 230 kgf/mm$^2$ although the ductility of the strand can be restored. The ductility of the strand can be represented by the elongation of the strand measured at the time of its fracture. In other words, the strand has higher ductility when the elongation of the same at the time of fracture is greater.

In the aging treatment in which a strain (a rate of plastic deformation) of less than 0.2% is given, the ductility cannot be restored even if the aging treatment is performed for about 24 minutes (point D) or even longer since the Si content of the material according to the invention is high, leading to considerable strain aging and hardening. Thus, the strand experiences a premature fracture in an elastic region during a tensile test. In other words, the strand has a low tensile strength and experiences embrittlement In a usual aging treatment in which no strain (no plastic elongation) is given, the tensile strength of the strand reaches only 210 to 230 kgf/mm$^2$ by performing the treatment for about 29 minutes (point E) or longer. Accordingly, the strand cannot have a high strength. If the aging treatment is continued for about 35 minutes in total (point F), the strand is suddenly softened.

Figure 4:
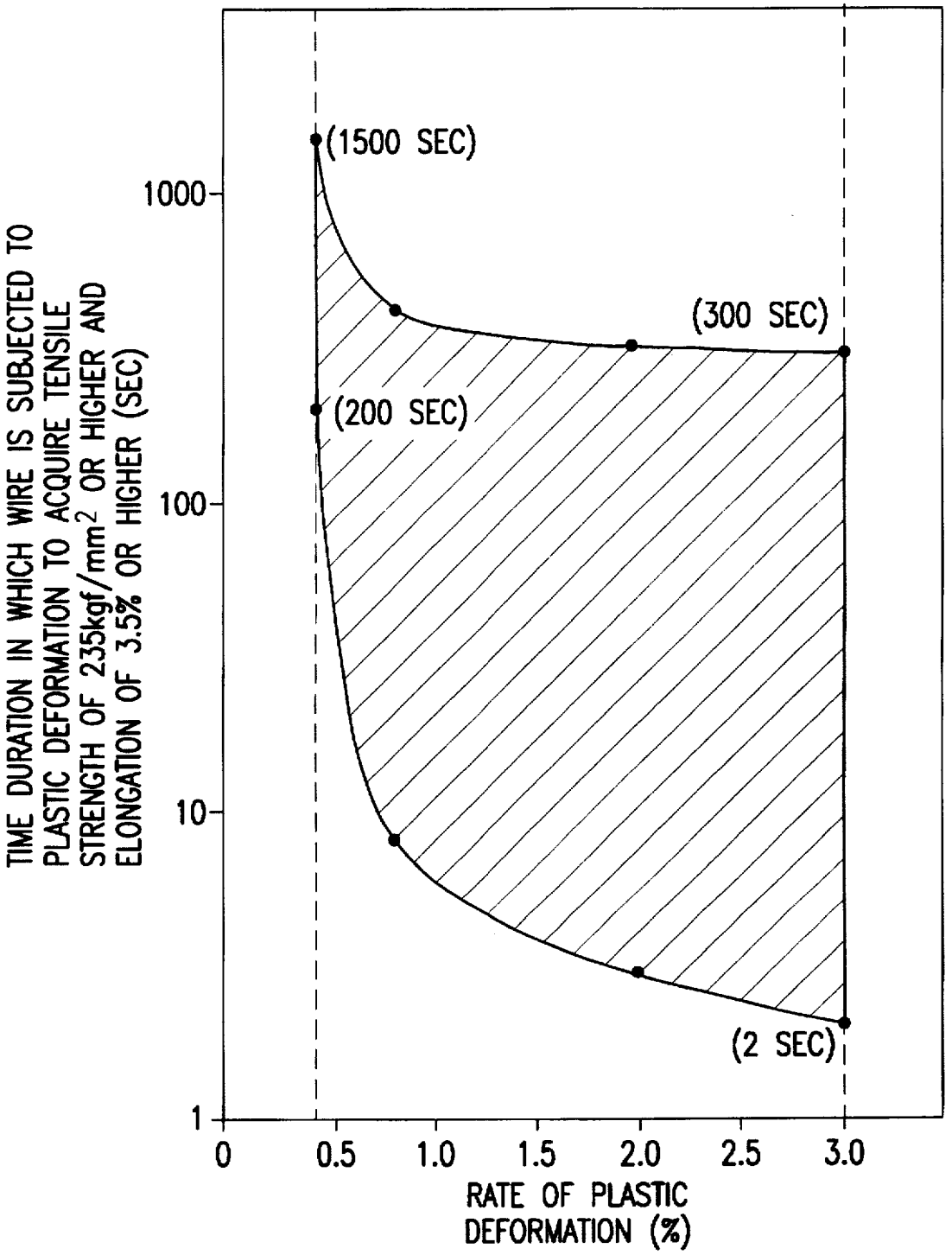
FIG. 4 is a graph showing a relationship between a strain (a rate of plastic deformation) caused by the plastic elongation and the plastic deformation holding time.

The plastic deformation holding time during the aging treatment at the aging temperature ranging from 200° C. to 600° C. as a function of a strain (also referred to as a rate of plastic deformation or a plastic elongation) is shown in FIG. 4. A curved line in the lower position shows the minimum aging treatment holding time as a function of the plastic elongation and a curved line in the higher position shows the maximum aging treatment holding time as a function of the plastic elongation. From this figure, the minimum time required to achieve the desired mechanical properties, i.e., a tensile strength of 235 kgf/mm$^2$ and an elongation of 3.5%, in case of the rate of plastic deformation (or a plastic elongation) applied to the strand being 3.0%, is 2 seconds and the maximum holding time to achieve the same properties is 5 minutes. If the plastic elongation is applied to the strand under the same aging conditions for more than 5 minutes, then it is likely that the strand becomes softened. Similarly, in case of the rate of plastic deformation (a plastic elongation) applied to the strand during the aging treatment being 0.4%, then minimum holding time to achieve the above-mentioned mechanical properties is 200 seconds and the maximum holding time is 1500 seconds. If the strain (a plastic elongation) is high, the softening occurs at an earlier stage. It can be concluded from this figure that the lower the plastic elongation applied to the strand during the aging treatment, the longer the holding time required to achieve the desired mechanical properties such as tensile strength and ductility. Accordingly, a maximum holding time for providing the satisfactory properties is shorter when the plastic elongation applied during the aging treatment becomes higher. Similarly, a minimum holding time for providing the satisfactory properties is shorter when the plastic elongation applied to during the aging treatment becomes higher. Thus, the aging treatment time may be suitably set as a function of the rate of plastic deformation (an plastic elongation) according to FIG. 4.

FIG. 2 shows that a treatment temperature of 200° to 600° C. is a condition for obtaining the strand having an elongation of 3.5% and a tensile strength of 235 kgf/mm$^2$. The aging treatment minimum holding time is 2 to 1200 seconds, depending upon the rate of plastic deformation applied to the strand. The rate of plastic deformation within the treatment temperature range is 0.4 to 3.0% (an area below the curve of 0.4% and above the curve of 3.0% in FIG. 2). It is also seen from FIG. 2 that the rate of deformation is desired to be 0.8 to 3.0% (an area below the curve of 0.8% and above the curve 3.0% in FIG. 2) in order to realize an elongation of 5.0% thereby to achieve even higher ductility.

Accordingly, FIG. 2 and FIG. 4 are to be referred to adequately find the aging treatment holding time; as FIG. 2 provides a minimum holding time to achieve possible mechanical properties as a function of a plastic deformation rate and an aging temperature and FIG. 4 provides a range of the holding time including a minimum holding time and a maximum holding time to achieve specified mechanical properties, a tensile strength of 235 kgf/mm$^2$ and an elongation of 3.5%.

The technical significance of obtaining the high strength steel for PC strand having high strength and high ductility lies in its characteristic metal structure. In other words, in this product, the cementite has a mixed structure of fibrous cementite and granular cementite.

Figure 3:
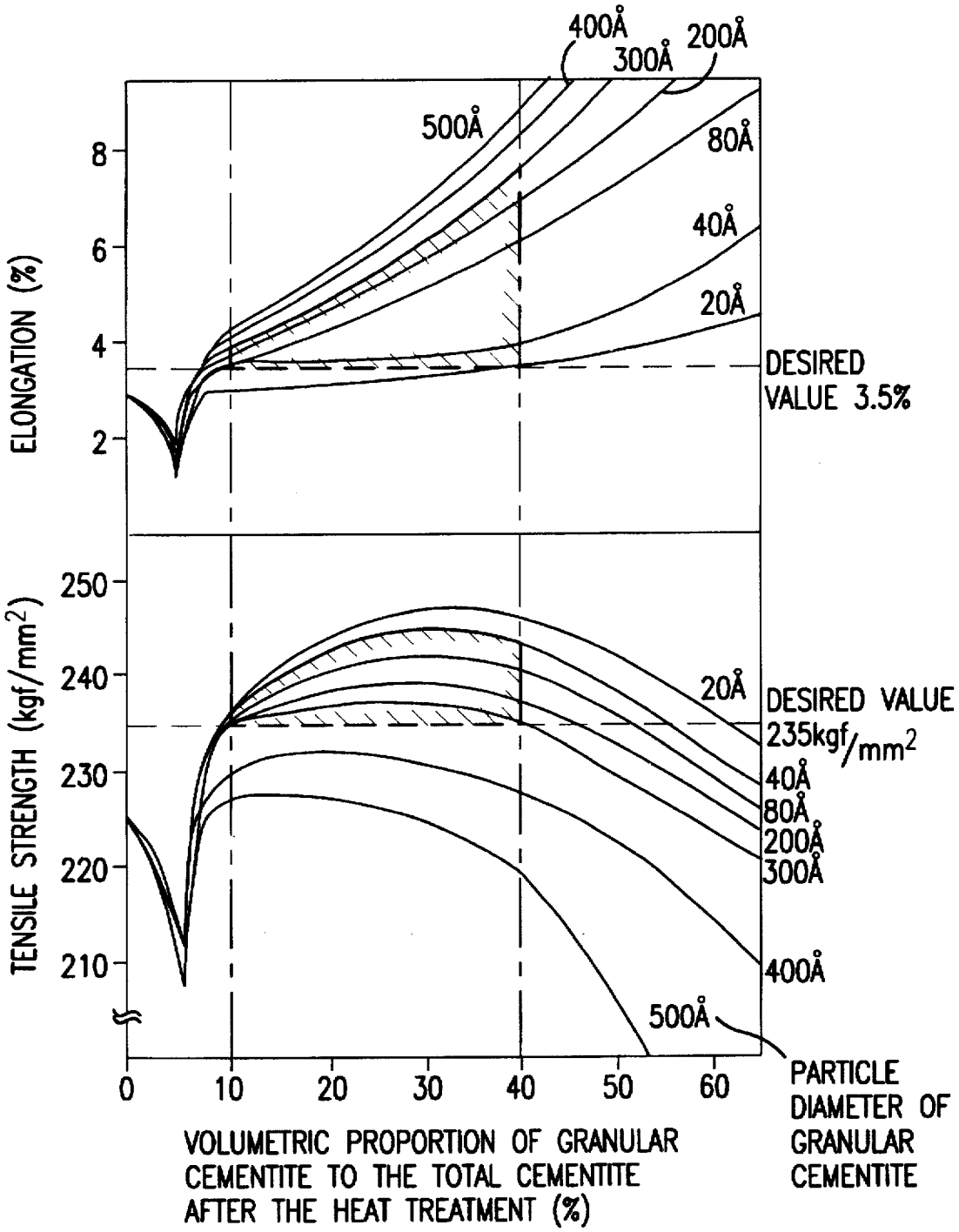
FIG. 3 is a graph showing effects of the particle diameter of granular cementite and the volumetric proportion of granular cementite to the total cementite after heating concerning the tensile strength and the elongation.

FIG. 3 shows a graph showing the ductility and tensile strength of the strand in relation to the volumetric proportion of the granular cementite to the total cementite and the particle diameter of the granular cementite after the aging treatment Cementite was obtained from the product by means of electrolytic extraction with a mixture of acetylacetone, methanol and tetramethyl ammonium chloride. The volumetric proportion of the granular cementite to the total cementite was determined by analyzing a picture obtained by scanning electron microscope analysis method. As clearly seen from FIG. 3, in order to obtain both properties: a tensile strength of 235 kgf/mm$^2$ or higher and an elongation of 3.5% or greater, the volumetric proportion of the granular cementite to the total cementite in the metal structure has to be 10 to 40% and the particle diameter thereof has to be to 40 to 300Å.

It is believed that no one has ever known that by performing the aging treatment while a specified deformation is given to the strand, the steel strand with a higher elongation can be obtained, while maintaining its high strength, due to its peculiar metal structure.

EXAMPLES OF THE INVENTION

After a steel wire rod having a diameter of 13 mm and made of a material containing 0.94% of C, 1.45% of Si, and 0.52% of Mn was lead-patented at 560° C., it was pickled with acid and coated with phosphate. The thus obtained wire rod was passed through dies of a continuous wire drawing apparatus 11 times (drawn 11 times) at a speed of 150 m/min. to obtain outer wire having a diameter of 4.22 mm and a core wire having a diameter of 4.4 mm. Seven of such wires are stranded to form a strand having a diameter of 12.7 mm. The aging treatment was performed at 200° to 600° C. for 2 to 6600 seconds, and the rate of plastic deformation was changed from 0 to 3.0% while the strand was held at that temperature. The results are shown in TABLE-1 to TABLE-3.

TABLE-1 shows test results in which the temperature holding time, the rate of deformation by plastic elongation, the volumetric proportion of granular cementite to the total cementite and the particle diameter of the granular cementite were changed during the aging treatment at 200° C. According to these test results, the strand having a tensile strength of 236 kgf/mm$^2$ or higher and an elongation of 3.6% or greater were obtained when the temperature holding time was 11 to 1200 seconds; the rate of plastic deformation 0.4 to 3.0%; the volumetric proportion of the granular cementite 10 to 35%; and the particle diameter of the granular cementite 40 to 300Å.

TABLE-2 shows results of the similar test when the aging treatment was performed at 400° C.

According to these test results, the strands having a tensile strength of 237 kgf/mm$^2$ or larger and an elongation of 4.0% or larger were obtained when the temperature holding time was 2.5 to 400 seconds; the rate of deformation 0.5 to 3.0%; the volumetric proportion of the granular cementite 10 to 30%; and the particle diameter of the granular cementite 50 to 300Å.

TABLE-3 shows results of the similar test when the aging treatment was performed at 600° C. According to these test results, the strands having a tensile strength of 236 kgf/mm$^2$ or higher and an elongation of 4.0% or greater were obtained when the temperature holding time was 2 to 120 seconds; the rate of plastic deformation 0.4 to 3.0%; the volumetric proportion of the granular cementite 15 to 40%; and the particle diameter of the granular cementite 40 to 100Å.

It can be seen from the above results that the strands having a tensile strength of 235 kgf/mm$^2$ or higher and an elongation of 3.5% or greater can be obtained at aging temperatures of 200° C., 400° C. and 600° C. under the conditions: a temperature holding time of 2 to 1200 sec. (20 min.), a rate of given plastic deformation of 0.4 to 3.0%, a volumetric proportion of the granular cementite of 10 to 40%, and a particle diameter of the granular cementite of 40 to 300Å.

As described in the above, the strand according to the invention is permitted to have a tensile strength of 235 kgf/mm$^2$ or higher and an elongation of 3.5% or greater by, in a wire material having a pearlite structure and containing specified amounts of C, Si and Mn, setting the volumetric proportion of granular cementite to the total cementite and the particle diameter of granular cementite within the specified ranges.

According to the method for manufacturing the above wire material, the wire material is patented, drawn and stranded. Thereafter, the strand is held at a temperature of 200° to 600° C. for 2 to 1200 seconds. While being held at that temperature, the strand is caused to undergo a plastic elongation of 0.4 to 3.0%, so that the aging treatment can be finished within a suitable time. According to this method, high strength steel strands for PC having a tensile strength of 235 kgf/mm$^2$ or higher, and an elongation of 3.5% or greater can be stably manufactured. The aging treatment according to this method is suitable from an industrial point of view.

The rate of plastic deformation given during the aging treatment according to the inventive method may be preferably set at 0.8 to 3.0%. By setting the rate of plastic deformation within the above range, high strength steel strands for PC having a tensile strength of 235 kgf/mm$^2$ or higher and an elongation of 5.0% or greater can be obtained.

A holding time during the aging treatment for the strand to undergo plastic deformation according to Tables 1 to 3 to achieve the desired properties ranges from 2 seconds to 1200 seconds, it should be noted that these numerical figures represent the minimum holding time required for the strand to be held. In FIG. 4, the left intersection point of the upper line with a vertical dotted line indicates a 1500 seconds along a Y-axis, in fact this value in time is a guideline for the maximum holding time for the strand to undergo plastic deformation during the aging treatment in case of 0.4% rate of plastic deformation.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

TABLE-1

| SAMPLE NO. | A | B | C | D | E | F | G | NOTE |
|---|---|---|---|---|---|---|---|---|
| A-1 | 200 | 6600 | 0 | 60 | 500 | 192 | 13.3 | COMP. EXAMPLE |
| A-2 | 200 | 5400 | 0 | 45 | 500 | 213 | 9.2 | CCMP. EXAMPLE |
| A-3 | 200 | 4000 | 0.1 | 5 | 30 | 182* | 0.5 | COMP. EXAMPLE |
| A-4 | 200 | 3000 | 0.2 | 10 | 500 | 226 | 4.0 | COMP. EXAMPLE |
| A-5 | 200 | 2000 | 0 | 5 | 50 | 190* | 1.2 | COMP. EXAMPLE |
| A-6 | 200 | 1800 | 0.4 | 12 | 500 | 226 | 4.5 | COMP. EXAMPLE |

TABLE-1-continued

| SAMPLE NO. | A | B | C | D | E | F | G | NOTE |
|---|---|---|---|---|---|---|---|---|
| A-7 | 200 | 1300 | 0.3 | 10 | 400 | 229 | 4.0 | COMP. EXAMPLE |
| A-8 | 200 | 1200 | 0.4 | 10 | 300 | 236 | 3.9 | INVENTION |
| A-9 | 200 | 100 | 0.7 | 10 | 40 | 237 | 3.6 | INVENTION |
| A-10 | 200 | 40 | 1.0 | 35 | 200 | 239 | 6.2 | INVENTION |
| A-11 | 200 | 15 | 2.5 | 30 | 80 | 245 | 5.2 | INVENTION |
| A-12 | 200 | 11 | 3.0 | 35 | 80 | 243 | 5.8 | INVENTION |
| A-13 | 200 | 8 | 3.0 | 8 | 20 | 229 | 3.0 | COMP. EXAMPLE |

*Premature fracture during a tensile test (brittle fracture)
A: Aging temperature (°C.)
B: Holding Time (sec.)
C: Rate of deformation caused by plastic elongation (%)
D: Volumetric proportion of granular cementite to the total cementite (%)
E: Particle diameter of granular cementite (Å)
F: Tensile strength (kgf/mm$^2$)
G: Elongation (%)

TABLE-2

| SAMPLE NO. | A | B | C | D | E | F | G | NOTE |
|---|---|---|---|---|---|---|---|---|
| B-1 | 400 | 2400 | 0 | 55 | 500 | 198 | 12.1 | COMP. EXAMPLE |
| B-2 | 400 | 1800 | 0.1 | 40 | 500 | 219 | 8.5 | COMP. EXAMPLE |
| B-3 | 400 | 1600 | 0 | 5 | 50 | 175* | 0.9 | COMP. EXAMPLE |
| B-4 | 400 | 1200 | 0.2 | 10 | 400 | 229 | 3.8 | COMP. EXAMPLE |
| B-5 | 400 | 1000 | 0.4 | 20 | 500 | 226 | 5.2 | COMP. EXAMPLE |
| B-6 | 400 | 800 | 0.3 | 8 | 100 | 227 | 3.2 | COMP. EXAMPLE |
| B-7 | 400 | 800 | 0 | 5 | 40 | 185* | 1.5 | COMP. EXAMPLE |
| B-8 | 400 | 400 | 0.5 | 10 | 300 | 237 | 4.2 | INVENTION |
| B-9 | 400 | 30 | 0.6 | 25 | 50 | 240 | 4.0 | INVENTION |
| B-10 | 400 | 10 | 1.0 | 30 | 200 | 240 | 5.8 | INVENTION |
| B-11 | 400 | 4 | 2.0 | 25 | 200 | 239 | 5.1 | INVENTION |
| B-12 | 400 | 2.5 | 3.0 | 30 | 100 | 242 | 5.4 | INVENTION |
| B-13 | 400 | 2 | 3.0 | 10 | 30 | 230 | 3.3 | COMP. EXAMPLE |

*Premature fracture during a tensile test (brittle fracture)
A: Aging temperature (°C.)
B: Holding Time (sec.)
C: Rate of deformation caused by plastic elongation (%)
D: Volumetric proportion of granular cementite to the total cementite (%)
E: Particle diameter of granular cementite (Å)
F: Tensile strength (kgf/mm$^2$)
G: Elongation (%)

TABLE-3

| SAMPLE NO. | A | B | C | D | E | F | G | NOTE |
|---|---|---|---|---|---|---|---|---|
| C-1 | 600 | 1000 | 0 | 57 | 500 | 195 | 12.4 | COMP. EXAMPLE |
| C-2 | 600 | 600 | 0 | 15 | 500 | 227 | 4.8 | COMP. EXAMPLE |
| C-3 | 600 | 540 | 0.1 | 5 | 75 | 193* | 1.0 | COMP. EXAMPLE |
| C-4 | 600 | 500 | 0.2 | 12 | 500 | 227 | 4.3 | COMP. EXAMPLE |
| C-5 | 600 | 400 | 0.4 | 20 | 500 | 225 | 5.0 | COMP. EXAMPLE |
| C-6 | 600 | 300 | 0.3 | 15 | 500 | 227 | 4.8 | COMP. EXAMPLE |
| C-7 | 600 | 300 | 0 | 5 | 180 | 198* | 1.8 | COMP. EXAMPLE |
| C-8 | 600 | 120 | 0.4 | 30 | 80 | 245 | 4.8 | INVENTION |
| C-9 | 600 | 20 | 0.7 | 15 | 100 | 236 | 4.0 | INVENTION |
| C-10 | 600 | 7 | 1.0 | 35 | 100 | 241 | 5.7 | INVENTION |
| C-11 | 600 | 2 | 2.5 | 35 | 80 | 240 | 6.0 | INVENTION |
| C-12 | 600 | 2 | 3.0 | 40 | 80 | 241 | 6.2 | INVENTION |
| C-13 | 600 | 1 | 3.0 | 8 | 50 | 230 | 3.1 | COMP. EXAMPLE |

*Premature fracture during a tensile test (brittle fracture)
A: Aging temperature (°C.)
B: Holding Time (sec.)
C: Rate of deformation caused by plastic elongation (%)
D: Volumetric proportion of granular cementite to the total cementite (%)
E: Particle diameter of granular cementite (Å)
F: Tensile strength (kgf/mm$^2$)
G: Elongation (%)

What is claimed is:

1. A high strength steel strand for PC of a wire material having a pearlite structure and containing 0.80 to 1.30% of C, 0.60 to 2.50% of Si and 0.30 to 1.50% of Mn, remainder being Fe and unavoidable impurities, wherein a cementite portion of the wire material comprises a mixed structure of fibrous cementite and granular cementite, the volumetric proportion of the granular cementite to the total cementite is 10 to 40%, the particle diameter of the granular cementite is 40 to 300Å, and the strand has a tensile strength of 235 $kgf/mm^2$ or higher and an elongation of 3.5% or greater.

2. A method of producing a high strength steel strand for PC of a wire material having a pearlite structure and containing 0.80 to 1.30% of C, 0.60 to 2.50% of Si and 0.30 to 1.50% of Mn, remainder being Fe and unavoidable impurities, comprising the steps of:

a lead patenting step in which the wire is lead patented;

a drawing step in which the wire is drawn;

a stranding step in which the wire is stranded;

an aging step in which the wire is applied with a plastic elongation of 0.4 to 3% while being kept at a temperature of 200° C. to 600° C. for a time duration of 2 to 1500 seconds.

3. A method of producing a high strength steel strand for PC as defined in claim 2, wherein the plastic elongation applied to the wire is 0.8 to 3%.

4. A method of producing a high strength steel strand for PC as defined in claim 2, wherein in the aging step a minimum time required for the wire to be subjected to the plastic elongation as a function of the aging temperature is determined in accordance with FIG. 2.

5. A method of producing a high strength steel strand for PC as defined in claim 2, wherein in the aging step a time range of the strand to be subjected to the plastic elongation is determined in accordance with FIG. 4.

6. A method of producing a high strength steel strand for PC as defined in claim 2, wherein in the aging step the time duration of the strand to be subjected to the plastic elongation as a function of the temperature and a function of the plastic elongation is determined in accordance with FIGS. 2 and 4.

* * * * *